US006023212A

United States Patent [19]

Mader

[11] Patent Number: 6,023,212

[45] Date of Patent: Feb. 8, 2000

[54] ELECTROMAGNETIC RELAY WITH MANUAL ACTUATOR

[75] Inventor: Leopold Mader, Moedling, Austria

[73] Assignee: EH-Schrack Components AG, Vienna, Austria

[21] Appl. No.: 09/108,668

[22] Filed: Jul. 1, 1998

[30] Foreign Application Priority Data

Jul. 1, 1997 [DE] Germany ..... 197 27 990

[51] Int. Cl.[7] ..... H01H 9/02; H01H 13/04

[52] U.S. Cl. ..... 335/202; 335/78; 335/86; 335/113; 335/186; 335/238

[58] Field of Search ..... 335/27, 78, 86, 335/113, 132, 157, 186, 202, 238, 167, 168; 200/295

[56] References Cited

U.S. PATENT DOCUMENTS 3,842,375 10/1974 Collette ..... 335/164
3,882,435 5/1975 Grass et al. ..... 335/164
4,393,360 7/1983 Arakawa et al. ..... 335/164
5,289,144 2/1994 Liao ..... 335/78

FOREIGN PATENT DOCUMENTS 0 514 892 A2 11/1992 European Pat. Off. .
6696936 1/1971 Germany .

*Primary Examiner*—Michael L. Gellner
*Assistant Examiner*—Raymond Barrera
*Attorney, Agent, or Firm*—Hill & Simpson

[57] ABSTRACT

An electromagnetic relay having a manual actuator wherein at an edge of the relay's housing is an opening formed in the shape of a mounting slot in which a pivot lever is mounted with a hinge segment. In an idle state, an outer lever segment of the pivot lever is lowered in a cavity of a housing wall while an inner lever arm extends along a housing wall perpendicular thereto. When the pivot lever is actuated, the inner lever arm actuates a movable relay part, in particular a bolt, up to a first operating position. When the pivot lever is rotated further, the inner lever arm can be locked with the movable relay part.

20 Claims, 3 Drawing Sheets

ELECTROMAGNETIC RELAY WITH MANUAL ACTUATOR

BACKGROUND OF THE INVENTION

1. Field of the Invention

The present invention relates to an electromagnetic relay having a housing in which a magnet system and a contact system are arranged in such a way that a movable relay part is positioned in the vicinity of the inner side of a housing wall. As such, an opening is provided in the region of this wall in which an actuator that can be moved by hand is movably arranged such that when it is actuated from the outside of the mechanism, an extension in the interior of the housing acts on the movable relay part.

2. Description of the Prior Art

A relay of the aforementioned type is known from EP 0 514 892 A2. There, an opening is provided in the housing that extends into the edge region and into two adjacent housing sides and which in the idle state, is closed by a test bolt having a substantially L-shaped cross-section. The test bolt is mounted in a partially-movable fashion in grooves of a first housing wall. By means of pressure on the test bolt in the direction of one or the other of the adjoining side walls, this bolt is deformed inward wherein a projection on its inner side acts on the armature of the relay in the sense of a switching motion. The test bolt thus requires a very large housing opening which is only partially covered by the test bolt and which permits only a limited stroke.

The aim of the present invention, therefore, is to create a relay of the type described above having a manual actuator in which a relatively large actuating stroke can be executed by hand along a relatively small housing opening and wherein, through simple modification, it is also possible to observe the switching positions in the interior of the relay.

SUMMARY OF THE INVENTION

According to the present invention, an actuator is provided which includes a pivoting lever having an outer lever arm located on the outer side of the housing, an inner lever arm located inside the housing, and a hinge segment which connects the two lever arms. The hinge segment is clamped into the opening that forms a mounting slot and permits a pivoting motion of the actuator about the longitudinal axis of the mounting slot.

Since the actuator is constructed as a pivot lever mounted in a narrow mounting slot of the relay housing, it is ensured that only a relatively small housing opening, in the form of this mounting slot, is necessary. In addition, such opening is largely sealed by the pivot lever so that even a motion of the pivot lever in the mounting slot does not enlarge the opening. Furthermore, the pivot lever allows a relatively large stroke to be produced as needed through the selectable length of the inner lever arm (which in the prior art is only conditionally possible), or through deformation of an actuator lying in the plane of a housing wall which, with other known relays, is possible only by means of a test button that protrudes out significantly.

Preferably, the mounting slot is fashioned in the area of the edge between the aforementioned first housing wall and a second housing wall that meets the first wall at, preferably, a right angle. As such, in the idle state, the outer lever arm extends approximately parallel to the first housing wall and the inner lever arm extends approximately parallel to the second housing wall. Further, the pivot axle of the pivot lever extends parallel to the housing edge while the movable relay part in the interior can be moved approximately parallel to the first housing wall. For the assembly of the pivot lever, which is made of one piece, it is preferably provided that a part, adjoining the mounting slot, of the first and/or the second housing wall is elastically deformable. Such part enables a snap-in mounting in the mounting slot of the hinge segment which has a reduced thickness in relation to the two lever arms. The terminating edge of the (first) housing wall which faces the mounting slot is thereby preferably rounded off in the shape of a cylinder segment. It is thereby additionally advantageous if the hinge segment of the pivot lever also has the shape of a hollow cylinder segment to match the aforementioned terminating edge. The outer side of the hinge segment may also include a smoothed catch surface that defines a catch position with the opposite terminating edge of the second housing wall.

In addition, a stop for determining a first operating position at a predetermined angular position can be provided at one of the housing walls and/or on the pivot lever itself. Preferably, the stop is constructed in such a way that it is overcome, e.g. broken off, given a further motion of the pivot lever into a second operating position. Thus, it is possible to provide as a stop at least one pin that protrudes transverse to the direction of motion of the pivot lever wherein such pin is broken off given a further movement of the pivot lever into the second operating position. However, it is also possible to provide one or two stop pins that protrude laterally parallel to the pivot axle and which are sheared off when the pivot lever moves into the second operating position at an edge of the opening.

As a movable relay part that can be actuated by the pivot lever, a bolt coupled with an armature and having at least one contact spring in the interior of the relay is preferably provided. Such bolt can be snapped into the second operating position with the inner lever arm wherein an operating position of the armature or, respectively, of the contact spring is locked.

If the movable relay part, preferably the bolt, can be moved in parallel along the first housing wall, the switching position of this relay part can be observed through a transparent window provided in the housing wall. For this purpose, the movable relay part may include an additional marking surface that can be positioned immediately at the window in a particular switching position.

Additional features and advantages of the present invention are described in, and will be apparent from, the Detailed Description of the Preferred Embodiments and the Drawings.

DETAILED DESCRIPTION OF THE PREFERRED EMBODIMENTS

Figure 1:
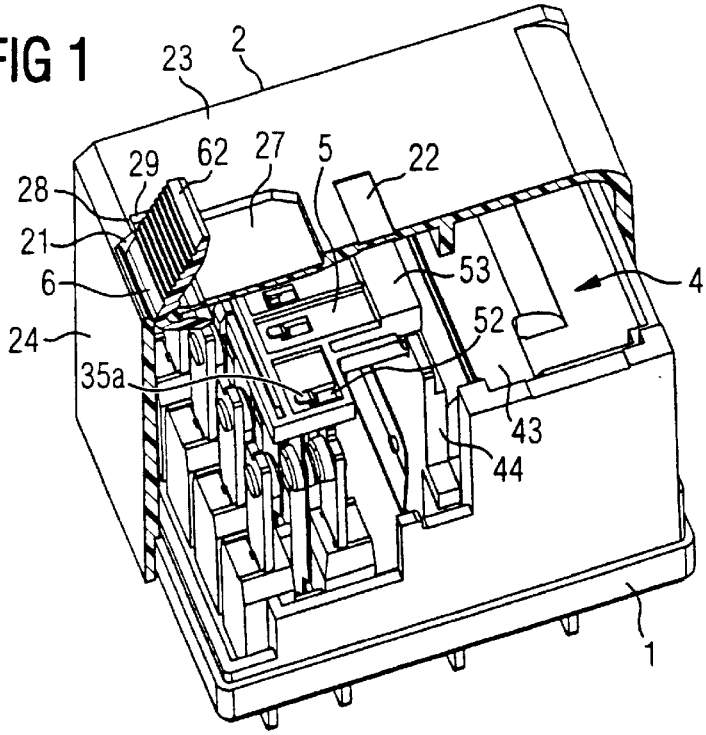
FIG. 1 shows a perspective view of an embodiment of the relay of the present invention with a partially cut-open housing.

The relay shown in FIGS. 1 through 4 has a housing with a base 1 and a cover 2 within which, for example, four switchover contact sets 3 and a magnet system 4 are arranged. Each switchover contact set 3 has both a break contact 32 and a make contact 34 which are anchored in the base 1 with corresponding fixed contact bearers. In addition, a contact spring 35 having a movable contact 36 is likewise fastened in the base via a spring mount 37. The magnet system 4 of the relay includes a coil 41 with a coil body 42, a substantially L-shaped core 43 and a substantially L-shaped armature 44. The core 43 is guided through the coil 41 with its long arm 43*a* so that on its free end the armature 44 is mounted with its short arm 44*b* so as to be able to be rolled away. The long arm 44*a* of the armature 44, in turn, forms an operating air gap with the short arm 43*b* of the core 43 or, respectively, with a pole segment 43*c* which is formed as an extension of the short core arm 43*b* and is bent off parallel to the coil axis. The armature 44 is guided in a pocket of the coil body 42 with its short arm 44*b* and is held in its position by an armature spring 45.

The movement of the armature 44 is transmitted to the contact springs 35 by a bolt 5. These springs 35 respectively engage a bent-off actuating pin 35*a* in an appertaining opening 52 of the bolt 5. The bolt 5 itself is plugged onto the free end of the armature arm 44*a* with a mouth-type opening 51 so that it is connected therewith in the manner of a joint and can be moved in its longitudinal direction approximately parallel to an upper housing wall 23 of the housing cover 2.

In the cover 2, a pivot lever 6 is arranged in an opening in the shape of a mounting slot 21 which is located in the region of the edge between the upper housing wall 23 and a vertical side wall 24. This pivot lever 6 forms both an outer lever arm 62 and an inner lever arm 63 which are approximately perpendicular to one another and which are connected via a hinge segment 64 whose cross-section is modified. With this hinge segment 64, the pivot lever 6 can be moved about a pivot axle that is parallel to the longitudinal direction of the mounting slot 21. Such axle is formed by a rounded-off terminating edge 25, in the shape of a segment of a cylinder (convex), of the upper housing wall 23 in the region of the mounting slot 21. In adaptation to this cylindrical terminating edge 25, the inner side of the mounting slot 64 is also formed in the shape of a segment of a hollow cylinder (concave).

In order to enable mounting of the inner lever arm 63 in the housing, the housing cover 2 is made of flexible plastic and is preferably thinned in its cross-section in the region of the mounting slot 21. For example, next to the terminating edge 25 a cross-sectional thinning or chamfering 26 is shown. In this way, the inner lever arm 63 can be snapped into the mounting slot 64 by deformation of the housing cover 2 and the housing cover 2 tightly seals the inner lever arm 63, and holds the pivot lever 6 captive.

Figure 2:
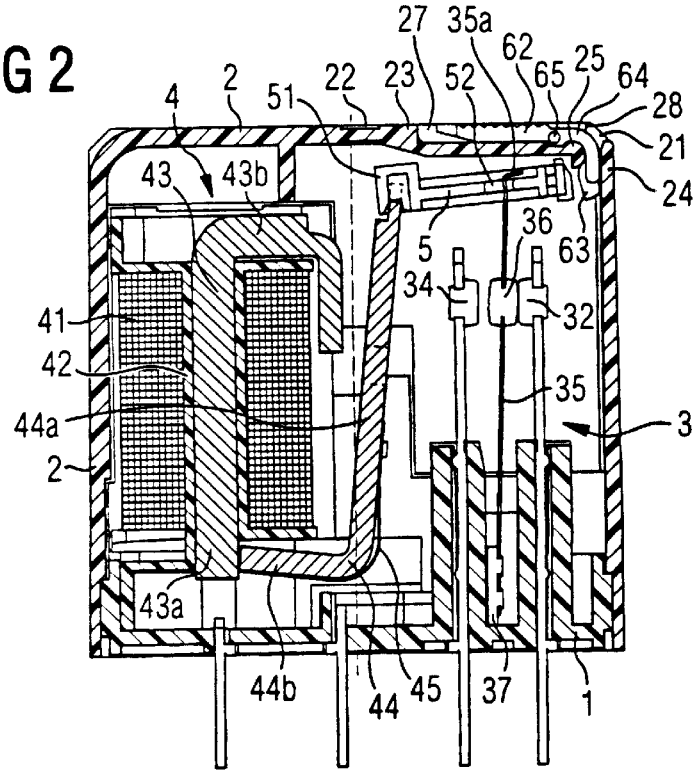
FIG. 2 shows the relay of FIG. 1 in a sectional view with a pivot lever in an idle position.

In the idle state, the pivot lever 6 lies with its outer lever arm 62 in a cavity 27 of the upper housing wall 23 so that it is sunk in the contour of the cover 2. The inner lever arm 63 thereby lies against the side wall 24. The pivot lever 6 is thus not engaged with the bolt 5 so that the relay can operate normally. This position is shown in FIG. 2.

Figure 3:
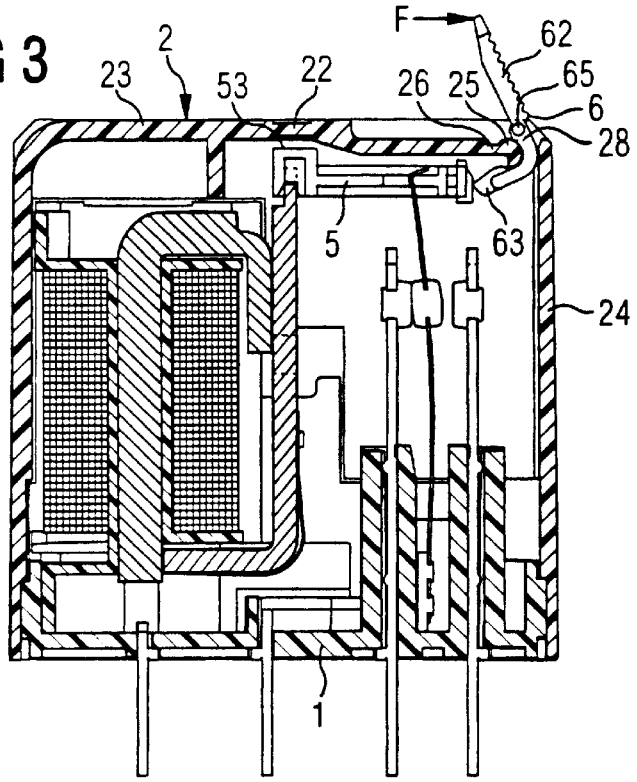
FIGS. 3 and 4 show the same view of the relay as in FIG. 2, but with the pivot lever in a first and a second operating position, respectively.
Figure 4:
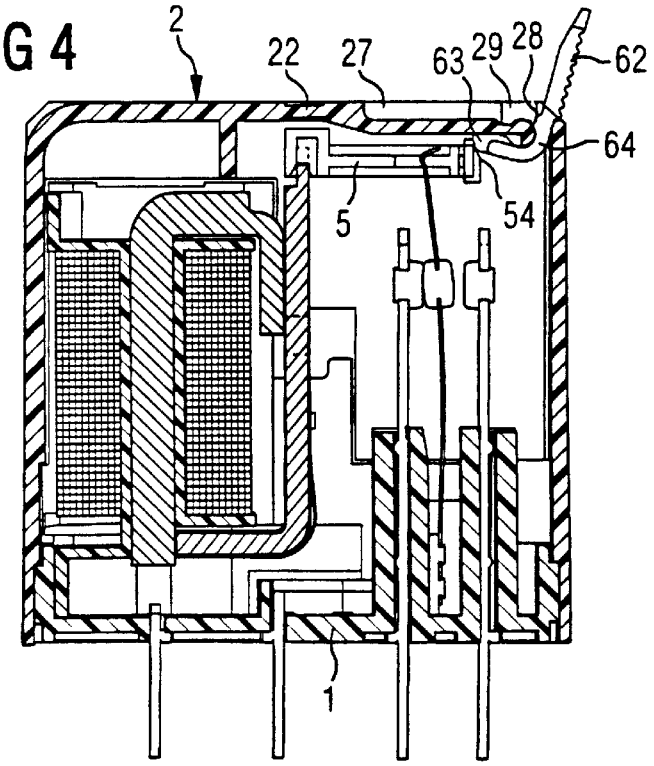

If the relay is to be actuated by hand, e.g. for testing purposes, the outer pivot arm 62 is pivoted out of the cavity 27 (with the force F) so that it assumes the position according to either FIG. 1 or FIG. 3. The first operating position achieved in this way is determined by two stop pins 65 which stand out laterally parallel to the pivot axle of the pivot lever 6 and, in this operating position, bump against an edge 28. In the idle state, these stop pins 65 lie in a lateral denting 29 of the cavity 27. If it is desired to arrest the relay system in the actuated state, the pivot lever 6 according to FIG. 4 is pivoted into a second operating position. For this purpose, the resistance of the stop pins 65 must be overcome. This means that given a rotation as in relation to FIG. 3, with the force F, the stop pins 65 on the edge 28 are sheared off. The inner pivot lever 63 thereby overcomes the dead point 54 on the bolt 5 and locks behind this dead point. The bolt 5 and the contact springs 35 are thus arrested in their operating position.

In addition, the switching position of the relay is shown in a transparent window 22 of the cover 2 with reduced cross-section. For this purpose, the bolt 5 has an end segment with an indicator surface 53 which, in the operating position of the bolt, lies immediately on the inner side of the window 22 and is thus visible from the outside. Of course, this indicator surface 53 can be constructed so as to be additionally noticeable; e.g., colored.

Figure 5:
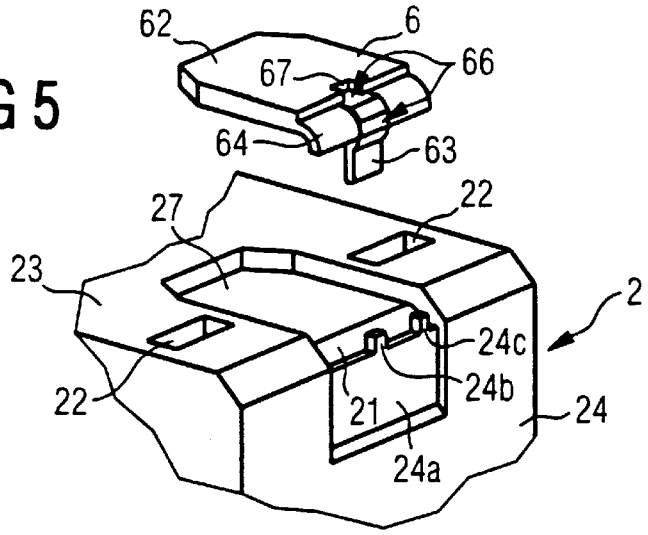
FIG. 5 shows an alternative embodiment of a pivot lever in relation to a portion of an associated housing.
Figure 6:
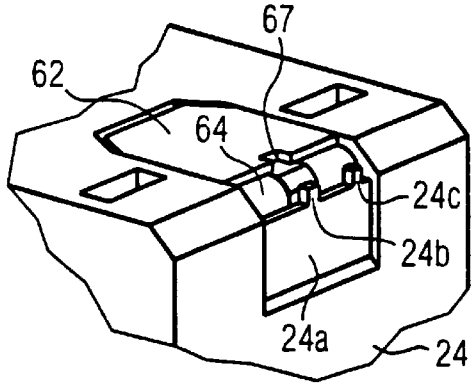
FIG. 6 shows the housing segment of FIG. 5 with the associated pivot lever in place.
Figure 7:
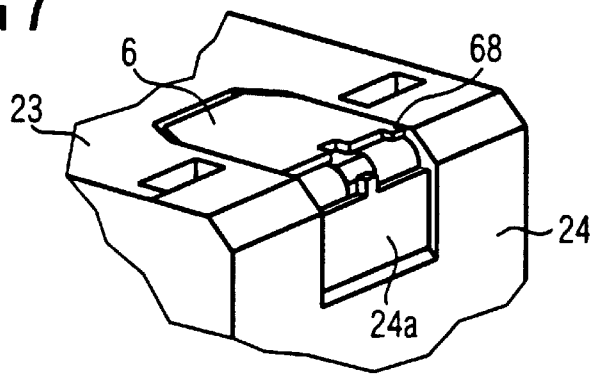
FIG. 7 shows the same view of the housing segment as in FIG. 6, but with another alternative embodiment of a pivot lever.

In FIGS. 5 through 7, alternative embodiments of the pivot lever 6 and its position in the housing are shown. Thus, in FIG. 5 a segment of the housing cover 2 with the mounting slot 21 is shown whereby the cover 2 not only includes the cavity 27 in the upper terminating wall 23 but also includes a wall segment 24*a* in the side wall 24 that has a thinned cross-section. As in the previous example, the pivot lever 6 has an outer lever arm 62, an inner lever arm 63 and a substantially hollow-cylindrical bearing segment 64. In the center region of this bearing segment 64, flattened snap surfaces 66 are provided which, after the setting of the pivot lever 6 into the mounting slot 21, can determine different operating positions together with the wall segment 24*a* or with the projection 24*b*. In this example, an arresting in the first operating position takes place by means of a stop pin 24*c* against which the first lever arm 62 strikes. Given further pivoting of the pivot lever 6 into the second operating position, the stop pin 24*c* is broken off. The projection 24*b* thereby engages in an opening 67 of the pivot lever 6. In a further modification in relation to FIG. 1, two windows 22 are provided lateral to the cavity 27. For indication, corresponding indicator surfaces are then also provided on the bolts, in a way not explicitly shown.

FIG. 7 shows a construction of the relay of the present invention similar to that shown in FIG. 6. In a further modification, only one stop pin 68 is provided on the pivot lever 6. Such pin 68 strikes the upper edge of the wall segment 24*a* in the first operating position and breaks off such upper edge given further pivoting into the second operating position.

Although the present invention has been described with reference to specific embodiments, those of skill in the art will recognize that changes may be made thereto with departing the spirit and scope of the present invention as set forth in the hereafter appended claims.

I claim as my invention:

1. An electromagnetic relay, comprising:

a housing having a first housing wall, a second housing wall and a mounting slot, wherein the second housing wall is connected to the first housing wall at a substantially right angle such that the mounting slot of the housing is formed at an intersecting edge between the first housing wall and the second housing wall;

a movable relay part within the housing positioned proximate the first housing wall wherein the movable relay part may be moved in a substantially parallel fashion with respect to the first housing wall; and a movable pivot lever extending through the mounting slot of the housing such that a pivot axle of the pivot lever is substantially parallel to the intersecting edge, the pivot lever including an outer lever arm positioned substantially external to the housing such that the outer lever arm is substantially parallel to the first housing wall in an idle relay state, an inner lever arm positioned substantially within the housing in operational engagement with the movable relay state, and hinge segment formed between the outer lever arm and the inner lever arm and pivotably mounted in the mounting slot of the housing.

a movable realy part within the housing positioned proximate the first housing wall; and a movable pivot lever extending through the mounting slot of the housing, the pivot lever including an outer lever arm postioned substantially external to the housing, an inner lever are postitioned substantially within the housing in operational engagement with the movable relay part, and a hinge segment formed between the outer lever arm and the inner lever arm and pivotably mounted in the mounting slot of the housing, wherein the hinge segment includes a flattened catch surface for engagement with a portion of the second housing wall at a catch position.

2. An electromagnetic relay as claimed in claim 1, further comprising:

a detachable stop member which defines a first operating position of the pivot lever when the stop member is attached and which defines a second operating position of the pivot lever when the stop member is detached.

3. An electromagnetic relay as claimed in claim 2, wherein the detachable stop member is a pin laterally protruding from the pivot lever, the pin positioned in an opening of the housing in an idle relay state, the pin engaging an edge of the opening in the first operating position, and the pin sheared off on the edge of the opening in the second operating position.

4. An electromagnetic relay as claimed in claim 1, wherein the movable relay part is a bolt coupled with an armature and includes at least one contact spring, such that the movable relay part may be moved in a substantially parallel fashion with respect to the first housing wall.

5. An electromagnetic relay as claimed in claim 4, further comprising:

a marking surface on the movable relay part for indication of the switching position of the movable relay part; and a transparent window in the first housing wall for viewing a switched position of the movable relay part.

6. An electromagnetic relay, comprising:

a housing having a first housing wall and a mounting slot;

a movable relay part within the housing positioned proximate the first housing wall; and a movable pivot lever extending through the mounting slot of the housing, the pivot lever including an outer lever arm positioned substantially external to the housing, an inner lever arm positioned substantially within the housing in operational engagement with the movable relay part, and a hinge segment formed between the outer lever arm and the inner lever arm and pivotably mounted in the mounting slot of the housing, wherein an elastically deformable part having a convex-shaped edge biased against the hinge segment is formed as part of the housing and positioned adjacent the mounting slot, the part biased against the hinge segment which has a concave-shaped edge for cooperative engagement with the convex-shaped edge of the deformable part to enable a snap-mounting of the hinge segment in the mounting slot.

7. An electromagnetic relay as claimed in claim 6, further comprising:

a detachable stop member which defines a first operating position of the pivot lever when the stop member is attached and which defines a second operating position of the pivot lever when the stop member is detached.

8. An electromagnetic relay as claimed in claim 7, wherein the detachable stop member is a pin laterally protruding from the pivot lever, the pin positioned in an opening of the housing in an idle relay state, the pin engaging an edge of the opening in the first operating position, and the pin sheared off on the edge of the opening in the second operating position.

9. An electromagnetic relay as claimed in claim 6, wherein the movable relay part is a bolt coupled with an armature and includes at least one contact spring, such that the movable relay part may be moved in a substantially parallel fashion with respect to the first housing wall.

10. An electromagnetic relay as claimed in claim 9, further comprising:

a marking surface on the movable relay part for indication of the switching position of the movable relay part; and a transparent window in the first housing wall for viewing a switched position of the movable relay part.

11. An electromagnetic relay, comprising:

a housing having a first housing wall and a mounting slot;

a movable relay part within the housing positioned proximate the first housing wall; and a movable pivot lever extending through the mounting slot of the housing, the pivot lever including an outer lever arm positioned substantially external to the housing, an inner lever arm positioned substantially within the housing in operational engagement with the movable relay part, and a hinge segment formed between the outer lever arm and the inner lever arm and pivotably mounted in the mounting slot of the housing, wherein an outer side of the first housing wall includes a notch section for cooperative receipt of the outer lever arm in an idle relay state.

12. An electromagnetic relay as claimed in claim 11, further comprising:

a detachable stop member which defines a first operating position of the pivot lever when the stop member is attached and which defines a second operating position of the pivot lever when the stop member is detached.

13. An electromagnetic relay as claimed in claim 12, wherein the detachable stop member is a pin laterally protruding from the pivot lever, the pin positioned in an opening of the housing in an idle relay state, the pin engaging an edge of the opening in the first operating position, and the pin sheared off on the edge of the opening in the second operating position.

14. An electromagnetic relay as claimed in claim 11, wherein the movable relay part is a bolt coupled with an armature and includes at least one contact spring, such that the movable relay part may be moved in a substantially parallel fashion with respect to the first housing wall.

15. An electromagnetic relay as claimed in claim 14, further comprising:

a marking surface on the movable relay part for indication of the switching position of the movable relay part; and a transparent window in the first housing wall for viewing a switched position of the movable relay part.

16. An electromagnetic relay, comprising:

a housing having a first housing wall, a second housing wall and a mounting slot, wherein the second housing wall is connected to the first housing wall at a substantially right angle such that the mounting slot of the housing is formed at an intersecting edge between the first housing wall and the second housing wall;

a movable relay part within the housing positioned proximate the first housing wall; and a movable pivot lever extending through the mounting slot of the housing, the pivot lever including an outer lever arm positioned substantially external to the housing, an inner lever arm positioned substantially within the housing in operational engagement with the movable relay part, and a hinge segment formed between the outer lever arm and the inner lever arm and pivotably mounted in the mounting slot of the housing, wherein the hinge segment includes a flattened catch surface for engagement with a portion of the second housing wall at a catch position.

17. An electromagnetic relay as claimed in claim 16, further comprising:

a detachable stop member which defines a first operating position of the pivot lever when the stop member is attached and which defines a second operating position of the pivot lever when the stop member is detached.

18. An electromagnetic relay as claimed in claim 17, wherein the detachable stop member is a pin laterally protruding from the pivot lever, the pin positioned in an opening of the housing in an idle relay state, the pin engaging an edge of the opening in the first operating position, and the pin sheared off on the edge of the opening in the second operating position.

19. An electromagnetic relay as claimed in claim 16, wherein the movable relay part is a bolt coupled with an armature and includes at least one contact spring, such that the movable relay part may be moved in a substantially parallel fashion with respect to the first housing wall.

20. An electromagnetic relay as claimed in claim 19, further comprising:

a marking surface on the movable relay part for indication of the switching position of the movable relay part; and a transparent window in the first housing wall for viewing a switched position of the movable relay part.

* * * * *